US008695154B2

(12) United States Patent
Sever et al.

(10) Patent No.: US 8,695,154 B2
(45) Date of Patent: Apr. 15, 2014

(54) VACUUM CLEANER WITH A SUCTION HOSE HOLDER

(75) Inventors: Eduard Sever, Ludesch (AT); Franz Huber, Markt Weld (DE); Joachim Vedder, Hergensweiler (DE); Dragomir Ljubojevic, St. Gallen (CH)

(73) Assignee: Hilti Aktiengesellschaft, Schaan (LI)

( * ) Notice: Subject to any disclaimer, the term of this patent is extended or adjusted under 35 U.S.C. 154(b) by 233 days.

(21) Appl. No.: 13/290,686

(22) Filed: Nov. 7, 2011

(65) Prior Publication Data

US 2012/0117752 A1 May 17, 2012

(30) Foreign Application Priority Data

Nov. 8, 2010 (DE) ..... 10 2010 043 580

(51) Int. Cl.
*A47L 9/00* (2006.01)

(52) U.S. Cl.
USPC ..... 15/323; 15/414; 285/7

(58) Field of Classification Search
USPC ..... 15/323, 414; 285/7
IPC ..... A47L 9/00
See application file for complete search history.

(56) References Cited

U.S. PATENT DOCUMENTS

| | | | | |
|---|---|---|---|---|
| 5,137,156 | A | 8/1992 | Riczinger et al. | |
| 5,303,447 | A | 4/1994 | McKight | |
| 6,848,144 | B1 | 2/2005 | McDonald | 15/246.2 |
| 2001/0018780 | A1 | 9/2001 | Hashizume et al. | |
| 2005/0211854 | A1 | 9/2005 | Berfield | 248/80 |
| 2007/0113528 | A1 | 5/2007 | Knuth et al. | |
| 2010/0325831 | A1 | 12/2010 | Lee et al. | 15/323 |

FOREIGN PATENT DOCUMENTS

| | | |
|---|---|---|
| DE | 601 23 688 | 8/2007 |
| EP | 1 419 723 | 5/2004 |
| EP | 1 922 969 | 5/2008 |
| GB | 2 402 045 A | 12/2004 |

*Primary Examiner* — David Redding
(74) *Attorney, Agent, or Firm* — Davidson, Davidson & Kappel, LLC

(57) ABSTRACT

A vacuum cleaner (11) with a housing (12) and a suction hose (16) as well as to a suction hose holder (31) arranged on the housing (12) that has two holding elements (32, 37) that are at a distance from each other and that each have a receptacle (34, 39) to hold two sections of the suction hose (16), whereby additional holders (20, 35, 40) are provided at the receptacles (34, 39).

5 Claims, 3 Drawing Sheets

VACUUM CLEANER WITH A SUCTION HOSE HOLDER

This claims the benefit of German Patent Application DE 10 2010 043 580.5, filed Nov. 8, 2010 and hereby incorporated by reference herein.

The invention relates to a vacuum cleaner with a suction hose holder.

BACKGROUND

The suction hose of a vacuum cleaner is a conduit that has an end piece with a suction opening for purposes of flexibly picking up dust and the like, and that can be affixed to a suction opening in the housing of the vacuum cleaner. In the case of a dust-generating power tool such as, for example, a floor grinder, a planing machine or a drilling/cutting device, the suction hose serves as a connection line that connects the power tool to the vacuum cleaner. In the second use, the suction hose transports dust-laden air from the dust-generating power tool directly to the collecting canister of the vacuum cleaner.

In order to ensure sufficient flexibility during the use of the vacuum cleaner, the suction hose is of a length that is normally greater than the dimensions of the vacuum cleaner. It is a known procedure to remove the suction hose from the housing of the vacuum cleaner in order to separately transport the vacuum cleaner from one work site to another work site. However, this solution involves extra work. Moreover, the suction hose could be inadvertently transported to a different place than the vacuum cleaner, which would cause unwanted delays in the work.

European patent specification 1 419 723 B1 describes a vacuum cleaner having a housing and a suction hose that has a device connection end that can be secured onto the housing as well as an end piece with a suction opening at the other free end, and having a suction hose holder arranged on the housing that has a holding element with a body that projects away from the housing and that has a receptacle to hold a section of the end piece of the suction hose.

SUMMARY OF THE INVENTION

In order to transport this prior-art vacuum cleaner, the end piece of the suction hose can be secured in the receptacle of the holding element. The receptacle of the holding element has a cylindrical configuration to accommodate the end piece of the suction hose, whereby this end piece has such an outer contour that, when it has been put in place, it is held in the receptacle by clamping. In order to ensure the clamping fixation, the receptacle of the holding element and the end piece of the suction hose have to be precisely coordinated with each other. If this is not the case, the suction hose is not held sufficiently securely on the housing of the vacuum cleaner after it has been wound up.

Another drawback of the prior-art solution is that users of the vacuum cleaner usually only wind up the suction hose loosely, so that it can happen that the end piece of the suction hose does not end up in a position in which it can be inserted into the receptacle of the holding element of the suction hose holder. For this reason, if applicable, the last coil of the suction hose might not have been wound up tightly enough, so that the suction hose is only wound up loosely and, as a result, it can fall off when the vacuum cleaner is transported.

It is an object of the present invention to provide a vacuum cleaner that does not have the above-mentioned drawbacks and that allows a simple, flexible and secure fixation of various sections of the suction hose to the vacuum cleaner.

The present invention provides a first holding mean or holder is provided on the first holding element in order to hold a first section of the suction hose, and a second holding means or holder is provided in order to hold another section of the suction hose.

Consequently, the at least one holding means has at least two fastening possibilities for at least two different sections of the suction hose. As a result, when the suction hose is wound up, an exact alignment of a particular section is no longer absolutely necessary in order to securely affix the suction hose onto the vacuum cleaner. Moreover, the fixation of the suction hose is no longer absolutely dependent only on the shape of the end piece of the suction hose, and different suction hoses that are configured to meet the connection requirements can be used on the same vacuum cleaner. This increases the flexibility and thus the application range of the vacuum cleaner. Moreover, such a suction hose holder has a higher level of usability over the service life of the vacuum cleaner in comparison to the approaches known so far.

With the embodiment according to the invention, a suction hose is held securely so that it does not accidentally fall off the vacuum cleaner, even in case of vibrations, for example, because the vacuum cleaner is being pulled over a rough floor. This rules out that possibility of damage occurring to the suction hose, for example, because it is dragged over the floor or because of other mechanical stresses such as, for instance, accidentally being stepped on by the user.

Advantageously, the end piece provided at the free end of the suction hose has an outer contour that is configured so as to taper, preferably conically, towards the free end, so that the end piece can simply be inserted into a receptacle of one of the holding elements.

Preferably, the suction hose holder comprises at least a second holding element that is arranged at a distance from the first holding element, whereby the additional holding element likewise has a body that projects from the housing and that has another receptacle to partially hold another section of the suction hose. Therefore, when the wound-up suction hose has been secured, it is affixed onto the housing of the vacuum cleaner on at least two points with additional clamping forces.

The suction hose holder can also have more than two holding elements that are at a distance from each other. Particularly in the case of vacuum cleaners having large dimensions or in the case of relatively long suction hoses, a suction hose holder with more than two holding elements is advantageous.

Preferably, at least a third holding element is provided for holding the additional section of the suction hose on the second holding element, so that, here too, an advantageous fixation of the appertaining section of the suction hose is ensured. Advantageously, the third holder is configured analogously or at least similarly to the first holder on the first holding element.

Preferably, at least a fourth holder is provided for holding a section of the suction hose on the second holding element, so that two different fastening possibilities also exist on the second holding element in order to affix appertaining sections of the suction hose.

Preferably, the receptacles of at least two holding elements are arranged on a shared receptacle axis, as a result of which the suction hose runs straight between them when it has been put in place.

Preferably, the second hose holder and/or the fourth hose holder have at least one holding bead provided on the inner contour of the appertaining receptacle, said holding bead reducing the cross section of the appertaining receptacle, at least in certain areas. The size of the cross section of the receptacle is advantageously adapted to the corresponding dimensions of the suction hose. Due to the narrowing in certain areas brought about by the holding bead, a clamping force is exerted onto the suction hose in certain areas, and this force can also comprise forces that act on the suction hose axially, that is to say, in the direction of its longitudinal axis. In this manner, the suction hose is additionally affixed onto the housing of the vacuum cleaner.

Normally, the suction hose has a corrugated outer structure. The at least one holding bead thus advantageously can be configured in such a way that, when the suction hose has been inserted into the receptacle, this holding bead engages with a valley, i.e. between two peaks, of the corrugated suction hose. Consequently, the suction hose is especially advantageously secured onto the housing of the vacuum cleaner against axial forces or forces that act along its longitudinal axis. Moreover, the corrugated suction hose is securely affixed in the corresponding receptacle with very little mechanical stress.

If the receptacle has an essentially cylindrical configuration, then the holding bead advantageously runs along the inner radius of this receptacle. If the suction hose holder has more than two holding elements that each have at least one receptacle, then all of these receptacles advantageously have at least one holding bead as an additional holder, for example, in order to secure sections of the suction hose that are at a distance from each other.

Preferably, the first holder and/or the third holder comprises a plug-in connection, whereby, when they have been put together, the first element of the plug-in connection is preferably held so as to be clamped in the second element of the plug-in connection. This measure ensures an advantageous fixation of the suction hose onto the housing.

Preferably, the first element of the plug-in connection has a projection and the second element of the plug-in connection has a receiving groove to accommodate the projection, thus allowing the plug-in connection to be configured in a simple manner.

Preferably, the projection is arranged on the appertaining holding element, whereby the projection surrounds the appertaining receptacle of the holding element, at least in certain areas, and it projects from the body of the appertaining holding element, and the receiving groove is preferably provided on the outside, on the free end of the suction hose, whereby the receiving groove runs along the circumference of the suction hose, at least in certain areas. Advantageously, the receiving groove is provided on the end piece of the suction hose. Thus, a simply configured plug-in connection exists between the free end or the end piece of the suction hose and the corresponding holding element of the suction hose holder. This advantageous design also makes it possible to secure the end piece of the suction hose to a holding element of the suction hose holder, whereby the design of the actual end piece is of secondary importance in terms of the shape of the receptacle of the corresponding holding element.

Preferably, at least two of the holding elements each have at least one projection, so that a correspondingly shaped free end of a suction hose can be secured alternatively to either holding element.

Preferably, the free ends of the holding flanges of two adjacent holding elements face each other, which allows the user to wind up the suction hose from either side.

In an alternative embodiment according to the invention, the projection is provided on the free end of the suction hose, preferably on the outside, whereby the projection runs along the circumference of the suction hose, at least in certain areas, and projects from it, and the receiving groove is arranged on the appertaining holding element, whereby the receiving groove surrounds the appertaining receptacle of the holding element, at least in certain areas. With this embodiment as well, a simply configured plug-in connection exists between the free end or the end piece of the suction hose and the corresponding holding element of the suction hose holder. This advantageous embodiment also allows the end piece of the suction hose to be secured onto a holding element of the suction hose holder, whereby the design of the actual end piece is of secondary importance in terms of the shape of the receptacle of the appertaining holding element.

Preferably, at least two of the holding elements each have at least one receiving groove, so that a correspondingly shaped free end of a suction hose can be secured alternatively to either holding element.

Preferably, the receiving grooves are provided on the sides of two adjacent holding elements that are facing each other, which allows the user to wind up the suction hose from either side.

Preferably, the vacuum cleaner has a collecting canister and a suction box that can be arranged on the collecting canister, whereby at least the first holding element of the suction hose holder is provided on the housing of the suction box. The suction hose holder is thus part of the removable suction box. Thanks to this advantageous measure, it is ensured that the suction hose that is wound up or secured on the suction hose holder does not get in the way when the collecting canister is being emptied or replaced.

BRIEF DESCRIPTION OF THE DRAWINGS

The invention will be explained schematically and by way of an example in greater detail on the basis of figures.

The figures are described in relation to each other and as a whole. Identical reference numerals refer to identical components.

Figure 1:
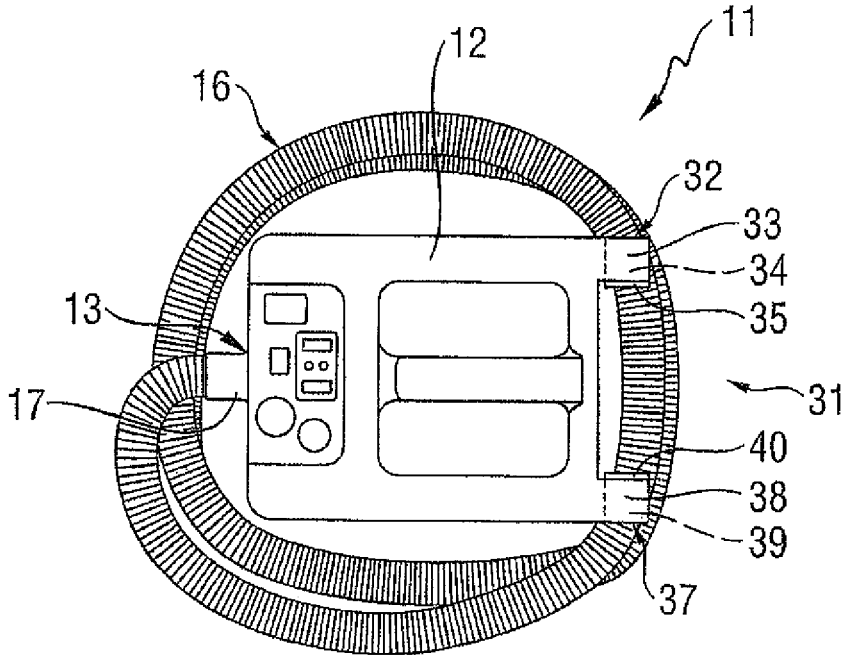
Figure 2:
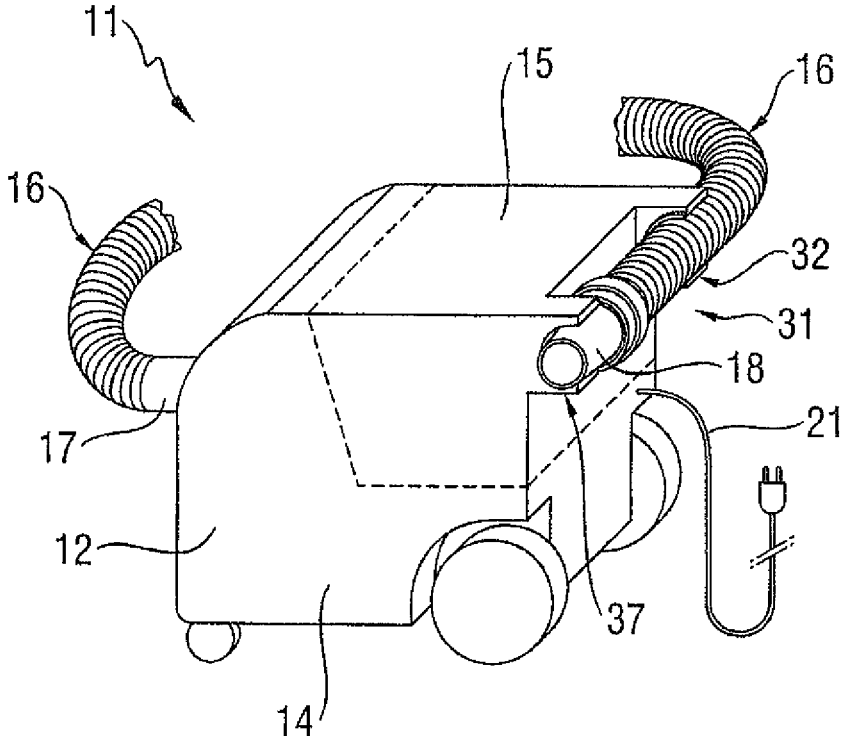
Figure 3:
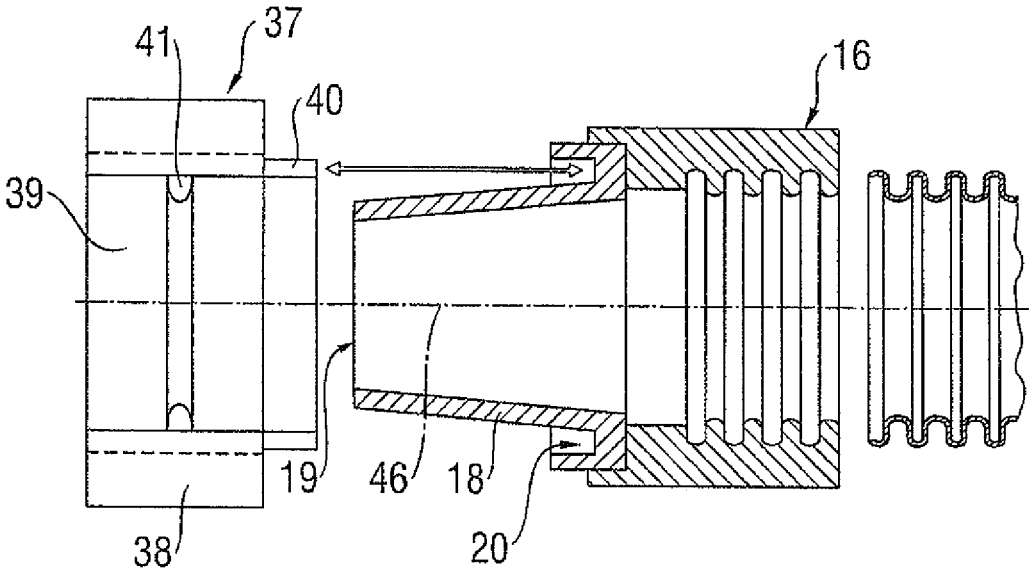
Figure 4:
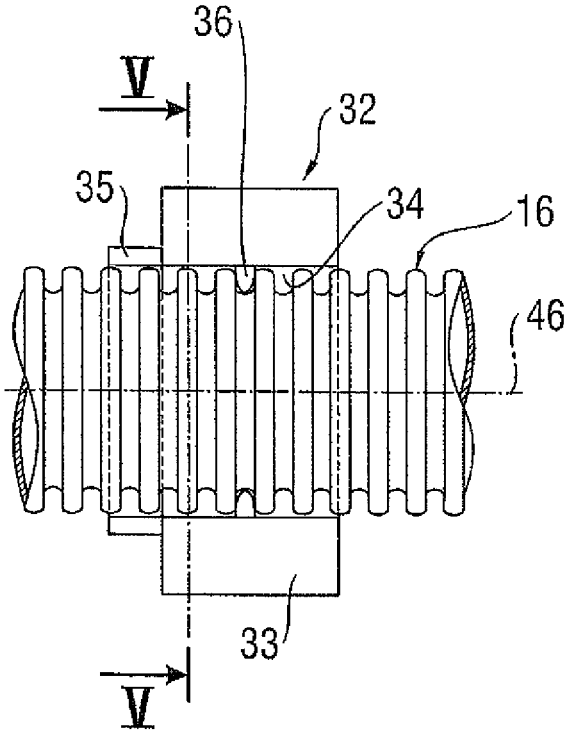
Figure 5:
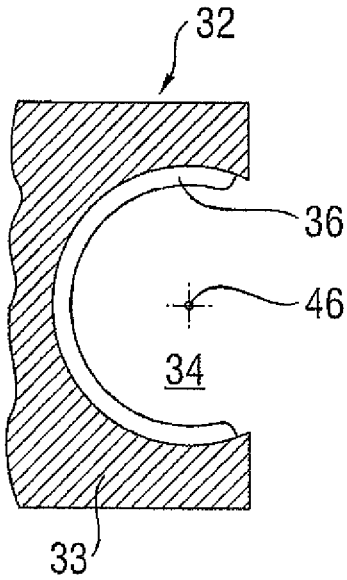
Figure 6:
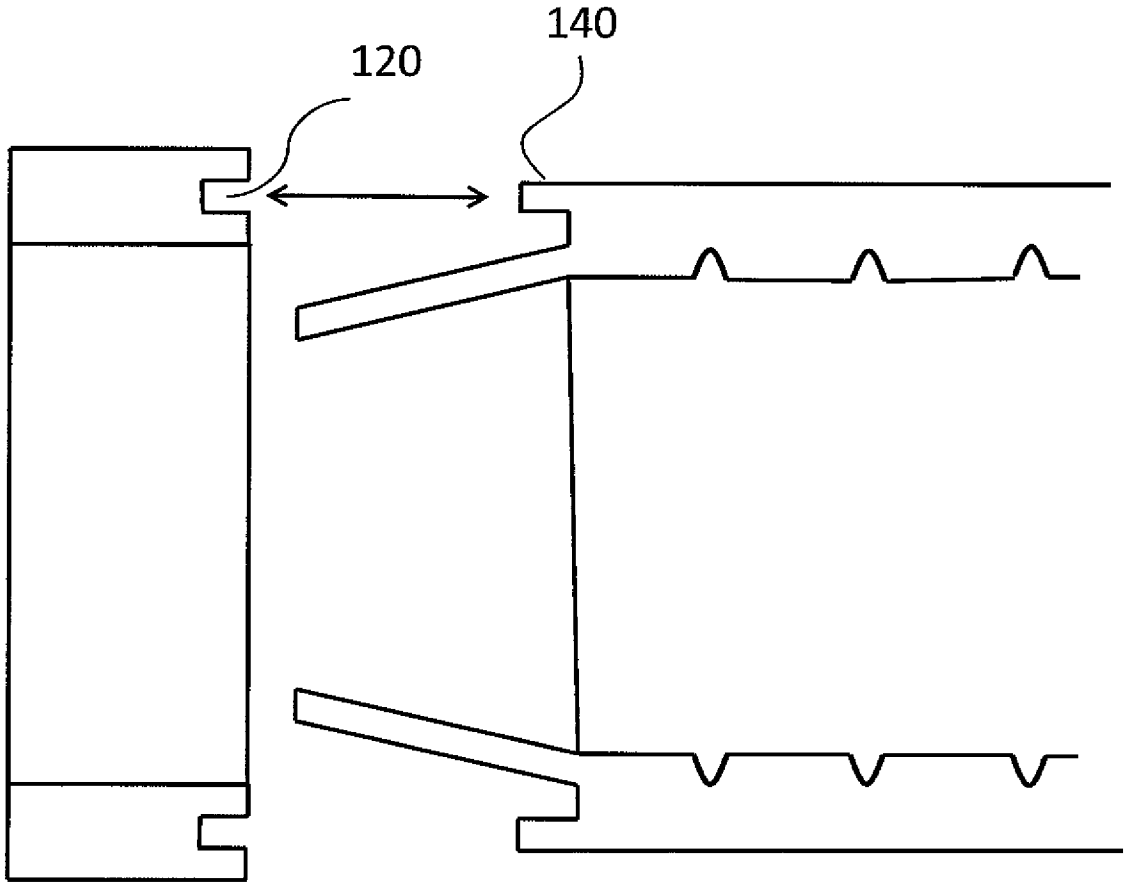

The following is shown:

FIG. 1 a top view of a vacuum cleaner with a suction hose holder that has a first and a second holding element, and a wound-up suction hose;

FIG. 2 a perspective view of the vacuum cleaner according to FIG. 1, whereby only the end areas of the wound-up suction hose are shown;

FIG. 3 a schematic partial sectional view of one of the holding elements of the suction hose holder as well as the end piece of the suction hose in the uncoupled state;

FIG. 4 the other holding element of the suction hose holder with the suction hose put in place;

FIG. 5 a side view of the holding element of FIG. 4 along the line V-V; and FIG. 6 a schematic side view of a further embodiment of the plug-in connection.

DETAILED DESCRIPTION

The vacuum cleaner 11 shown in FIGS. 1 and 2 has a housing 12 and a suction hose 16. The vacuum cleaner 11 comprises a collecting canister 14 in which picked-up dust particles are collected, as well as a suction box 15 in which a suction source is provided. The suction source comprises, for example, a fan that is driven by a motor and that generates an air current. The air current flows through a suction opening 13 provided on the housing 12.

In the vacuum cleaner 11 shown here, the suction source is supplied with electric power via a power cord 21 that can be connected to the mains power supply. As an alternative or in addition to this, the vacuum cleaner 11 can also be supplied with the power needed for its operation, for example, by means of accumulators arranged in the vacuum cleaner 11. The vacuum cleaner 11 is advantageously configured as a wet-dry vacuum cleaner.

The suction hose 16 has a device connection end 17 that can be secured onto the housing 12 as well as an end piece 18 with a suction opening on the other, free end 19. The device connection end 17 is advantageously configured in such a way that the suction hose 16 is secured onto the housing 12 detachably. For example, this connection is configured as a bayonet joint, whereby, in an especially advantageous manner, part of the bayonet joint surrounds the suction opening 13 in the housing 12 and the other, complementary part of the bayonet joint is provided on the device connection end 17 of the suction hose 16.

Moreover, a suction hose holder 31 is arranged on the housing 12 of the vacuum cleaner 11 or on its suction box 15, and this suction hose holder has a first holding element 32 and a second holding element 37, which are arranged at a distance from each other.

The first holding element 32 has a body 33 that projects from the housing and that has a receptacle 34 to hold a section of the suction hose 16. Moreover, a projection 35—as a first holder—is provided on the side of the body 33 that faces the second holding element 37, and this projection 35 surrounds the receptacle 34 in certain areas, and it projects from the body 33 of the first holding element 32.

The second holding element 37 likewise has a body 38 that projects from the housing 12 and that has a receptacle 39 to hold a section of the suction hose 16. In this embodiment, the end piece 38 of suction hose 16 is secured in the second holding element 37. Moreover, a projection 40—as an additional third holder—is provided on the side of the body 38 that faces the first holding element 32, and this projection 40 surrounds the receptacle 39 in certain areas, and it projects from the body 38 of the second holding element 37.

Thus, both holding elements 32 and 37 each have a projection 35 or 40, whereby the free ends of the projections 35 and 40 face each other.

As can be seen especially clearly in FIGS. 3 to 5, the receptacle 34 of the first holding element 32 and the receptacle 39 of the second holding element 37 are arranged on a shared receptacle axis 46.

Furthermore, the receptacle 34 of the first holding element 32 has a holding bead 36 that—as the second holding means—runs along the inner circumferential section of the receptacle 34 and reduces the cross section of the receptacle 34, in certain areas.

The receptacle 39 of the second holding element 37 has a holding bead 41 that—as the fourth holding means—runs along the inner circumferential section of the receptacle 39 and reduces the cross section of the receptacle 39, in certain areas.

In this embodiment, the two holding beads 36 and 41 are configured identically.

The end piece 18 of the suction hose 16 shown in detail in FIG. 3 has an outer contour that tapers conically towards its free end. In this embodiment, at a distance from the free end 19, the end piece 18 of the suction hose 16 has a receiving groove 20 arranged on the outside, which runs over the entire circumference of the end piece 18. The receiving groove 20 thus forms a ring-shaped receptacle in which the projection 35 or 40 comes to rest when the end piece 18 is inserted into the receptacle 34 of the first holding element 32 or into the receptacle 39 of the second holding element 37. The projections 35 and 40 facing each other have coordinated shapes. The projections 35 and 40 and the receiving groove 20 are elements of a plug-in connection and are configured in such a way that, when they are put together, the appertaining projection 35 or 40 is held so as to be clamped in the receiving groove 20.

The individual details described in conjunction with the figures can, of course, also be provided for the other embodiments. For example, in an alternative embodiment according to the invention shown schematically in FIG. 6, the projection 140 is provided on the free end of the suction hose, preferably on the outside, whereby the projection runs along the circumference of the suction hose, at least in certain areas, and projects from it, and the receiving groove 120 is arranged on the appertaining holding element, whereby the receiving groove surrounds the appertaining receptacle of the holding element, at least in certain areas.

The list of reference numerals below and the technical teaching of the claims are to be construed as falling within the scope of the disclosure and, either together or in combination with the figures, they disclose additional details of the invention and its embodiments to the person skilled in the art.

LIST OF REFERENCE NUMERALS

11 vacuum cleaner
12 housing
13 suction opening
14 collecting canister
15 suction box
16 suction hose
17 device connection end of 16
18 end piece of 16
19 free end of 18
20 receiving groove
21 power cord 21
31 suction hose holder
32 first holding element
33 body of 32
34 receptacle of 32
35 projection of 32
36 holding bead of 32
37 second holding element
38 body of 37
39 receptacle of 37
40 projection of 37
41 holding bead of 37
46 receptacle axis
120 receptacle
140 projection

What is claimed is:

1. A vacuum cleaner comprising:

a housing;

a suction hose having a device connection end securable onto the housing and an end piece with a suction opening at an other free end; and a suction hose holder arranged on the housing and having a holding element with a body projecting from the housing and a receptacle to hold a section of the suction hose on the housing, the holding element having a first holder to hold a section of the suction hose and further comprising a second holding element to hold another section of the suction hose;

wherein the first holder includes at least a first element of a plug-in connection; wherein the suction hose has a second element of the plug-in connection, when the first element and the second element have been put together, the first element of the plug-in connection being clamped in the second element of the plug-in connection; wherein the first element of the plug-in connection has a projection and the second element of the plug-in connection has a receiving groove to accommodate the projection; and wherein the projection surrounds the receptacle, at least in certain areas, and projects from the body of the holding element.

2. The vacuum cleaner as recited in claim 1 wherein the receiving groove is provided on an outside, on the free end of the suction hose, the receiving groove running along a circumference of the suction hose, at least in certain areas.

3. The vacuum cleaner as recited in claim 2 wherein the suction hose holder includes a second holding element, the second holding element having a second projection.

4. The vacuum cleaner as recited in claim 3 wherein free ends of the projection and the second projection face each other, the holding element and second holding element being adjacent to each other.

5. A vacuum cleaner comprising:

a housing;

a suction hose having a device connection end securable onto the housing and an end piece with a suction opening at an other free end; and a suction hose holder arranged on the housing and having a holding element with a body projecting from the housing and a receptacle to hold a section of the suction hose on the housing, the holding element having a first holder to hold a section of the suction hose and further comprising a second holding element to hold another section of the suction hose;

wherein the first holder includes at least a first element of a plug-in connection;

wherein the suction hose has a second element of the plug-in connection, when the first element and the second element have been put together, the first element of the plug-in connection being clamped in the second element of the plug-in connection; wherein the second element is a projection provided on an outside, on the free end of the suction hose, the projection running along the circumference of the suction hose, at least in certain areas, and projects from it, and the receiving groove is arranged on the holding element, the receiving groove surrounding the receptacle of the holding element, at least in certain areas.

* * * * *